United States Patent [19]

Oberg

[11] 4,035,856

[45] July 19, 1977

[54] WATER SKI SAFETY FLAG

[75] Inventor: Gary R. Oberg, Spirit Lake, Iowa

[73] Assignee: Berkley & Company, Inc., Spirit Lake, Iowa

[21] Appl. No.: 709,634

[22] Filed: July 29, 1976

[51] Int. Cl.[2] ..... B63C 9/21

[52] U.S. Cl. ..... 9/313; 116/124 R; 116/173; 224/5 R

[58] Field of Search ..... 116/173, 174, 124 B, 116/124 R; 9/9, 14, 313; 224/5 R, 8 R, 6, 58, 5 J, 5.1; 24/16 R, 16 PB, 198, 200

[56] References Cited

U.S. PATENT DOCUMENTS

| | | | |
|---|---|---|---|
| 2,118,708 | 5/1938 | Johnson | 9/313 |
| 3,122,736 | 2/1964 | Weber | 9/313 |

*Primary Examiner*—S. Clement Swisher
*Assistant Examiner*—Denis E. Corr
*Attorney, Agent, or Firm*—Orrin M. Haugen

[57] ABSTRACT

A visual marker means for attachment to the floatation gear of a water skier to enable the skier to be more readily detected when down in the water. The marker means includes a staff having a flag member secured to the upper end thereof, and attachment means are secured to the lower end of the staff to permit releasable attachment of the staff and flag member to the floatation gear of the water skier. The attachment means includes a resilient belt or strap member which is coupled at its upper end to the staff, and at its lower end to the staff securing buckle or plate, the attachment being such that the belt and the staff form a closed loop for the attachment of the safety flag to the floatation gear of the skier.

4 Claims, 4 Drawing Figures

WATER SKI SAFETY FLAG

BACKGROUND OF THE INVENTION

The present invention relates generally to an improved means for detection of downed water skiers, and more specifically to a marker means for quick attachment to the floatation gear normally worn by water skiers. The marker means provides significant assistance in detection of downed water skiers, and furthermore provides this assistance without hindering or impeding the skier during the normal skiing activity. The marker further provides assistance in the detection of the location of a skiier in conditions of extreme chop or swells, when the skier otherwise would be out of visual sight of the tow boat for significant periods of time. As a further use for the device, the marker provides assistance in observing a skier who may be closely positioned relative to a boat having a transom which may, in certain situations, render it difficult or impossible to locate the skier, even though he may be in a normal skiing posture.

Water skiing has become a popular sport over recent years, along with the increase in popularity generally in boating. As the interest in both sports increases, the number of boats present on a given body of water also increases. While boating traffic does not present unusual risks to a water skier while skiing, this traffic does present problems to a downed skier. It will be appreciated that the only portion of the skier visible from the surface is the skier's head, and since the skier may be downed in an area remote from shore, his presence may not be readily detected by other watercrafts.

Water skiing is, of course, undertaken at relatively high speeds. While in most instances when a water skier falls, the occupants of the boat will be aware of his fall, it does happen from time to time that an interval of time transpires between the point of falling, and the point of awareness of the fall to those occupants of the towing boat or craft. Because of the high speeds involved, a significant distance may be interposed between the downed skier and the craft, and in these instances, detection of the downed skier may present a problem both to the towing boat or craft and to other boats in the area. The apparatus of the present invention provides a visual marker which may be worn by the water skier, the marker including a flag member secured to the upper end thereof to provide a ready reference point for detection of the skier. This detection is enhanced for both the occupants of the towing boat or craft as well as other boats or crafts in the area.

Basically, the visual marker means of the present invention includes a staff member having a flag at the upper end thereof, and having an attachment means at the lower end thereof to permit the staff and its flag to be releasably attached to the flotation gear of the water skier. Since floatation gear may be available in a wide variety of types, sizes, and configurations, the apparatus of the present invention provides a means for attachment to virtually any type or style of floatation gear normally worn by water skiers. The system of attachment includes an adjustable belt means which is coupled at its upper end to the flag staff, and at its lower end to the staff securing buckle of the assembly, the arrangement being such that the belt means together with the staff form a closed loop for the releasable coupling of the staff and flag member to the floatation gear of the skier.

SUMMARY OF THE INVENTION

Therefore, it is a primary object of the present invention to provide an improved visible marker means for attachment to the floatation gear of a water skier, wherein the marker means provides a flag member or the like which is elevated above the head of the skier, and which is therefore more readily detectable to occupants of nearby watercraft.

It is yet a further object of the present invention to provide a visual marker means for attachment to the floatation gear of a water skier, wherein the marker means provides little, if any, hindrance or interference with the normal activity of the water skier while skiing.

It is yet a further object of the present invention to provide an improved marker means for attachment to the floatation gear of a water skier, wherein the attachment means is arranged to accommodate various sizes, styles, and types of that floatation gear normally worn by water skiers.

Other and further objects of the present invention will become apparent to those skilled in the art upon a study of the following specification, appended claims, and accompanying drawing.

DESCRIPTION OF THE PREFERRED EMBODIMENT

Figure 1:
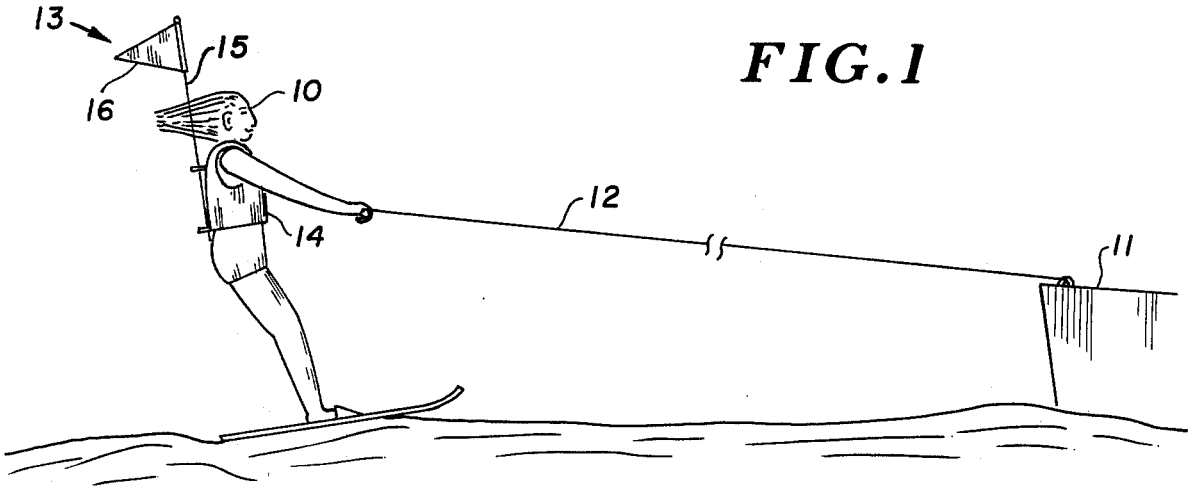
FIG. 1 is a view of a skier wearing a floatation vest, and having the visual marker means of the present invention secured to the floatation vest.

In accordance with the preferred embodiment of the present invention, and with particular attention being directed to FIG. 1 of the drawing, the water skier generally designated 10 is shown as being towed by boat 11, with the tow rope 12 being used for this purpose. Skier 10 is shown as wearing a marker means generally designated 13, with the marker 13 being, in turn, secured to the floatation vest 14 of the skier. As is indicated, the marker means generally designated 13 includes a staff member 15 with a flag 16 secured to the upper end thereof. Specifically, the upper tip of the shaft or staff 15 is folded in upon itself in order to provide a gripping surface for the flag, and also, and perhaps more importantly, to form a rounded surface which will eliminate problems of injury to the body of the skier due to contact with the free tip portion of the staff 15.

It is a particular feature of the invention to provide a material of construction for staff member 15 which has a carefully selected modulus of elasticity. This modulus is sufficiently high so as to reduce or eliminate any problems due to the storing of energy upon flexure of the shaft or staff member during normal use and operation. In particular, the modulus of elasticity of the typical construction is fiberglass having a modulus of elasticity of between 3 million and 4 million, with the material being contained within a polyester resin. This provides a modulus of elasticity for the entire structure of somewhere between 3 million and 4 million, due to the excessive contribution of the glass to this property of the product.

Figure 2:
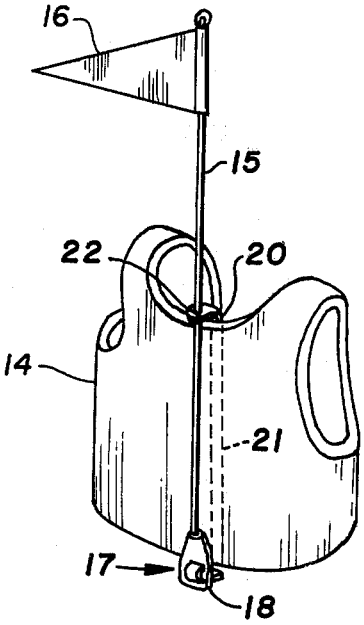
FIG. 2 is a perspective view, on a larger scale, of a floatation vest having the visual marker means of the present invention attached thereto, with a portion of the adjustable belt means of the structure being illustrated in phantom.
Figure 4:
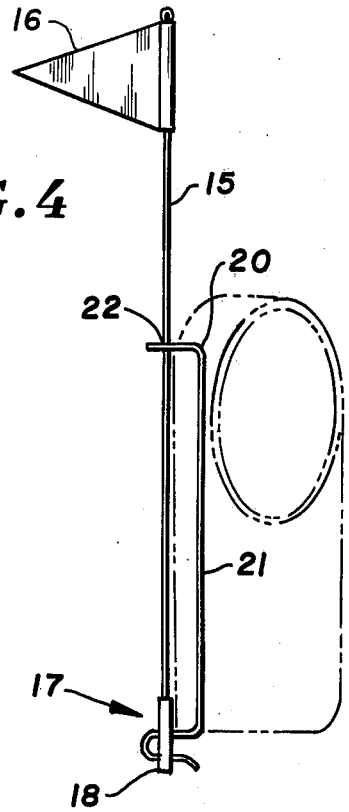
FIG. 4 is a side elevational view of the visual marker means of the present invention, and taken generally along the line and in the direction of arrows 4—4 of FIG. 2.

With attention now being directed to FIG. 2 of the drawing, it will be seen that the staff 15 is provided with an attachment means generally designated 17 at the base thereof. The attachment means 17, as indicated, comprises a staff securing buckle 18 having a bore formed therein for coupling the base of the staff 15 thereto. It will be appreciated, of course, that securing buckle 18 may have a blind bore formed therein for receiving staff 15, or, alternately, a series of staff receiving slots may be formed therein for coupling the base of staff 15 thereto. Adjustable belt means 20 is provided, with belt 20 having a shank portion 21 and a hole formed therein as at 22. Hole 22 as indicated, is arranged to receive the shank of staff 15 therewithin. The base of adjustable belt means 20 is, as indicated, passed through a series of generally parallelly disposed slots formed in buckle 18, with three such slots being provided for purposes of adjustably securing belt 20 to buckle 18.

As is indicated in FIG. 2, the termination of the adjustable belt means 20 and staff 15 forms a closed loop which, in turn, releasably couples the marker means to the floatation vest. Floatation vest 14 has a body portion, as indicated, which is interposed between belt 20 and staff 15. Since the sizes of vests normally worn by skiers varies, the belt 20 may be adjusted to any desirable length in order to accommodate these various sizes. As an alternate construction, a pair of conventional D-rings may be used, with these devices being typically used on life vests and related structures. Still a further alternate which may be found useful is the utilization of a belt having perforations spaced at reasonably regular intervals therealong, and with the base tip end of the staff 15 having a complementary post thereon with a reasonably spherical shaped tip thereon which may be passed through the appropriate perforation in the belt so as to secure the base portion of the structure to the life vest.

Figure 3:
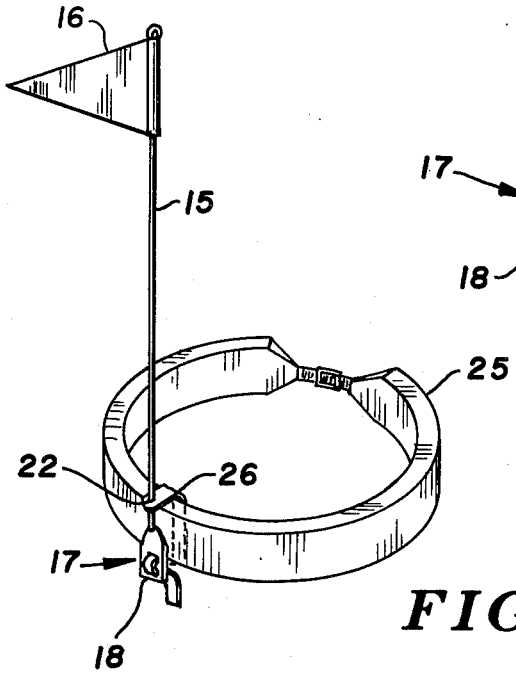
FIG. 3 is a view similar to FIG. 2, and showing the visual marker means of the present invention secured to a modified form of floatation gear, such as a floatation belt.

Attention is now directed to FIG. 3 of the drawing wherein the visual marker means of the present invention is illustrated as being attached to a floatation belt, this being an alternate form of floatation gear normally worn by water skiers. In this arrangement, floatation belt 25 is enveloped by the closed loop formed by adjustable web or belt 26 and staff 15. In this arrangement, if desired, a shorter length of web or belt may be employed, with web or belt 26, in this instance, having a shorter length than the corresponding belt 20 illustrated in FIG. 2.

In the normal wearing of this visual marker means, either the embodiment illustrated in FIG. 2, or that of FIG. 3, the position of the flag and its relationship to the skier is such that it neither hinders nor interferes with the normal actions of the skier while skiing. Specifically, the skier may perform any of the ordinary maneuvers without being encumbered or troubled with the presence of the visual marker means. Furthermore, the marker means is arranged so as to be readily attached to the various sizes and configurations of floatation gear, with the attachment in each instance being such that the skier is neither hindered nor bothered by the presence of the device.

For materials of construction, the staff 15 is preferably a fiberglass shaft, although other materials may be equally suited. Securing buckle 18 may also be fabricated of fiberglass, but other materials such as polyethylene, polypropylene, ABS, nylon, or the like may be employed for this purpose as appropriately selected.

It will be appreciated that the flag member 16 may be brilliantly colored in order to enhance visibility, and as such, fluorescent colors may be employed for this purpose. When wearing such a marker in the water, the added height of the flag 16 over the surface of the water significantly increases the visibility and detectability of the skier when down and swimming, particularly while awaiting return of the tow boat for pick up or resumption of skiing.

I claim:

1. Visual marker means for attachment to the floatation gear of a water skier and comprising:

a. staff means having a flag member secured to the upper end thereof and attachment means secured to the lower end thereof, and adjustable belt means for releasably coupling said staff and said attachment means to the floatation gear of a water skier;

b. said attachment means comprising a staff securing buckle for retaining said staff therein, said buckle having slots formed therein for releasably and adjustably receiving the lower end of said belt means in firm engagement therewith; and c. said adjustable belt means having a bore formed therein at the upper end thereof for receiving said staff in slidable engagement therewith, the arrangement being such that said staff and said belt means form a closed loop for the releasable coupling of said visual marker means to the floatation gear of a water skier.

2. The visual marker means as defined in claim 1 being particularly characterized in that said adjustable belt means is fabricated from rubber.

3. The visual marker means as defined in claim 1 being particularly characterized in that said flag member is mounted with a fluorescent material which glows in response to solar radiation.

4. The visual marker means as defined in claim 1 being particularly characterized in that said staff means is a fiberglass shaft.

* * * * *